US012091931B2

(12) United States Patent
McCarthy

(10) Patent No.: US 12,091,931 B2
(45) Date of Patent: Sep. 17, 2024

(54) SLIP SYSTEM FOR USE IN DOWNHOLE APPLICATIONS

(71) Applicant: Schlumberger Technology Corporation, Sugar Land, TX (US)

(72) Inventor: Matthew Carroll McCarthy, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/263,410

(22) PCT Filed: Jan. 10, 2022

(86) PCT No.: PCT/US2022/011801
§ 371 (c)(1),
(2) Date: Jul. 28, 2023

(87) PCT Pub. No.: WO2022/164621
PCT Pub. Date: Aug. 4, 2022

(65) Prior Publication Data

US 2024/0084667 A1 Mar. 14, 2024

Related U.S. Application Data

(60) Provisional application No. 63/144,321, filed on Feb. 1, 2021.

(51) Int. Cl.
*E21B 33/129* (2006.01)
*E21B 23/06* (2006.01)

(52) U.S. Cl.
CPC ..... *E21B 33/1292* (2013.01); *E21B 23/06* (2013.01)

(58) Field of Classification Search
CPC ..... E21B 33/129; E21B 33/1291; E21B 33/1292; E21B 23/06
See application file for complete search history.

(56) References Cited

U.S. PATENT DOCUMENTS 900,440 A * 10/1908 Spang ..... E21B 33/1291 166/138
1,476,727 A 12/1923 Quigg
(Continued)

FOREIGN PATENT DOCUMENTS

CN 103097656 A 5/2013
CN 103261582 A 8/2013
(Continued)

OTHER PUBLICATIONS

International Search Report and Written Opinion of the PCT Application No. PCT/CA2017/050555, filed Aug. 29, 2017 (6 pages).
(Continued)

*Primary Examiner* — Blake Michener
*Assistant Examiner* — Yanick A Akaragwe
(74) *Attorney, Agent, or Firm* — Jeffrey D. Frantz

(57) ABSTRACT

A technique facilitates operation of a slip assembly, e.g. a frac plug assembly, having a plurality of slips. The plurality of slips may selectively be forced in a radially outward direction via, for example, a cone so as to set the slips against a surrounding casing or other tubing. The slip assembly further comprises a mechanism which allows different amounts of radial movement of individuals slips to ensure sufficient setting of the individual slips when the surrounding tubing is oval or otherwise out of round.

14 Claims, 4 Drawing Sheets

(56) References Cited

U.S. PATENT DOCUMENTS

| | | | |
|---|---|---|---|
| 2,230,712 | A | 2/1941 | Bendeler |
| 2,364,419 | A | 12/1944 | Barnes |
| 4,697,640 | A | 10/1987 | Szarka |
| 4,735,264 | A | 4/1988 | Burris, II et al. |
| 4,901,794 | A | 2/1990 | Baugh et al. |
| 5,217,075 | A | 6/1993 | Wittrisch |
| 5,353,873 | A | 10/1994 | Cooke, Jr. |
| 5,390,737 | A | 2/1995 | Jacobi |
| 5,819,846 | A | 10/1998 | Bolt, Jr. |
| 6,443,458 | B1 | 9/2002 | Jansch |
| 6,538,576 | B1 | 3/2003 | Schultz et al. |
| 6,766,854 | B2 | 7/2004 | Ciglenec et al. |
| 7,140,434 | B2 | 11/2006 | Chouzenoux et al. |
| 7,543,635 | B2 | 6/2009 | East et al. |
| 8,211,248 | B2 | 7/2012 | Marya |
| 8,231,947 | B2 | 7/2012 | Vaidya et al. |
| 8,469,109 | B2 | 6/2013 | Wang et al. |
| 8,567,494 | B2 | 10/2013 | Rytlewski et al. |
| 8,839,855 | B1 | 9/2014 | McClinton et al. |
| 8,899,317 | B2 | 12/2014 | Frazier |
| 9,033,041 | B2 | 5/2015 | Baihly et al. |
| 9,045,963 | B2 | 6/2015 | Shkurti et al. |
| 9,212,547 | B2 | 12/2015 | Miller et al. |
| 9,611,709 | B2 | 4/2017 | Malley |
| 9,896,920 | B2 | 2/2018 | Holder |
| 9,982,505 | B2 | 5/2018 | Rytlewski et al. |
| 9,988,867 | B2 | 6/2018 | Jacob et al. |
| 9,988,870 | B2 | 6/2018 | Gray |
| 10,138,706 | B2 | 11/2018 | Baihly et al. |
| 10,233,720 | B2 | 3/2019 | Tse et al. |
| 10,301,910 | B2 | 5/2019 | Whitsitt et al. |
| 10,301,927 | B2 | 5/2019 | Sallwasser |
| 10,316,616 | B2 | 6/2019 | Stafford et al. |
| 10,352,121 | B2 | 7/2019 | Wise |
| 10,364,629 | B2 | 7/2019 | Jacob et al. |
| 10,450,829 | B2 | 10/2019 | Melenyzer et al. |
| 10,458,200 | B2 | 10/2019 | Tse |
| 10,508,526 | B2 | 12/2019 | Ring et al. |
| 10,538,988 | B2 | 1/2020 | Pabon |
| 10,619,084 | B2 | 4/2020 | Okura |
| 10,689,971 | B2 | 6/2020 | Smith |
| 10,738,561 | B2 | 8/2020 | Kobayashi |
| 10,801,315 | B2 | 10/2020 | Fripp |
| 2004/0026079 | A1* | 2/2004 | Johnson ..... E21B 43/108 166/227 |
| 2004/0241049 | A1 | 12/2004 | Carvalho |
| 2009/0038790 | A1* | 2/2009 | Barlow ..... E21B 33/1204 166/89.2 |
| 2010/0186970 | A1 | 7/2010 | Burnett |
| 2010/0276159 | A1 | 11/2010 | Mailand et al. |
| 2011/0139466 | A1 | 6/2011 | Chen |
| 2013/0133883 | A1 | 5/2013 | Hill, Jr. |
| 2013/0140042 | A1 | 6/2013 | Benson et al. |
| 2014/0190685 | A1* | 7/2014 | Frazier ..... E21B 33/129 166/135 |
| 2014/0363692 | A1 | 12/2014 | Marya et al. |
| 2015/0107825 | A1 | 4/2015 | Miller et al. |
| 2015/0122493 | A1 | 5/2015 | Wood et al. |
| 2015/0176386 | A1 | 6/2015 | Castillo |
| 2015/0300121 | A1 | 10/2015 | Xu |
| 2016/0097269 | A1 | 4/2016 | Kuehl et al. |
| 2016/0138362 | A1 | 5/2016 | Dockweiler |
| 2016/0186511 | A1 | 6/2016 | Coronado et al. |
| 2016/0265304 | A1* | 9/2016 | Liu ..... E21B 23/01 |
| 2016/0290095 | A1 | 10/2016 | Cromer |
| 2016/0299253 | A1 | 10/2016 | Zhang et al. |
| 2016/0348485 | A1 | 12/2016 | Castillo et al. |
| 2017/0130553 | A1 | 5/2017 | Harris et al. |
| 2017/0138150 | A1 | 5/2017 | Yencho |
| 2017/0145781 | A1 | 5/2017 | Silva |
| 2017/0335644 | A1 | 11/2017 | Ciezobka |
| 2017/0335678 | A1 | 11/2017 | Ciezobka et al. |
| 2017/0362914 | A1 | 12/2017 | Wise et al. |
| 2018/0112486 | A1 | 4/2018 | Potts et al. |
| 2018/0252091 | A1 | 9/2018 | Bustos et al. |
| 2018/0306001 | A1 | 10/2018 | Themig |
| 2018/0340391 | A1 | 11/2018 | Gray |
| 2018/0371895 | A1 | 12/2018 | Taal |
| 2019/0010780 | A1* | 1/2019 | Clemens ..... E21B 17/1014 |
| 2020/0149381 | A1 | 5/2020 | Ring et al. |
| 2020/0316822 | A1 | 10/2020 | Bourquard |
| 2020/0325748 | A1 | 10/2020 | Sanchez et al. |
| 2020/0347694 | A1 | 11/2020 | Power et al. |
| 2021/0317724 | A1 | 10/2021 | Romer |
| 2021/0363854 | A1 | 11/2021 | Tu |
| 2022/0056779 | A1 | 2/2022 | Aviles et al. |

FOREIGN PATENT DOCUMENTS

| | | | |
|---|---|---|---|
| CN | 103835677 | A | 6/2014 |
| CN | 103857872 | A | 6/2014 |
| CN | 104514513 | A | 4/2015 |
| CN | 104989317 | A | 10/2015 |
| CN | 106460504 | A | 2/2017 |
| CN | 108180014 | A | 6/2018 |
| RU | 2316643 | C2 | 2/2008 |
| RU | 2382197 | C1 | 2/2010 |
| RU | 2397319 | C2 | 8/2010 |
| RU | 2467160 | C2 | 11/2012 |
| RU | 2469180 | C2 | 12/2012 |
| RU | 2469188 | C2 | 12/2012 |
| RU | 2492318 | C2 | 9/2013 |
| RU | 154511 | U1 | 1/2015 |
| RU | 2633883 | C1 | 10/2017 |
| RU | 2668602 | C1 | 10/2018 |
| WO | 2018160070 | A1 | 9/2018 |
| WO | 2018184742 | A1 | 10/2018 |
| WO | 2019023413 | A1 | 1/2019 |
| WO | 2020131991 | A1 | 6/2020 |

OTHER PUBLICATIONS

International Preliminary Report on Patentability issued in PCT Application No. PCT/CA2017/050555, dated Nov. 6, 2018 (4 pages).

Decision of Grant issued in the RU application 2018140969, dated Aug. 27, 2020 (15 pages).

Office Action issued in the CN application 201780041754.3, dated Oct. 29, 2020 (9 pages).

International Search Report and Written Opinion issued in PCT Application PCT/US2019/067046, dated Apr. 23, 2020 (12 pages).

International Preliminary Report on Patentability issued in PCT Application No. PCT/US2019/067046, dated Jul. 1, 2021, 9 pages.

Second Office Action issued in the CN application 201780041754.3 dated Jul. 21, 2021, 10 pages with English translation.

Official Notification and Search Report of Russian Patent Application No. 2021121015 dated Dec. 16, 2021, 12 pages with English translation.

International Search Report and Written Opinion issued in PCT Application PCT/US2022/011801, dated Apr. 22, 2022.

First Office Action issued in Chinese Patent Application No. 2019800777143 dated Jan. 13, 2023, 22 pages with English translation.

Decision on Refusal to Grant issued in Russian Patent Application No. 2021121015 dated Aug. 4, 2022, 9 pages with English translation.

Second Office Action issued in Chinese Patent Application No. 2019800777143 dated Jun. 27, 2023, 25 pages with English translation.

* cited by examiner

SLIP SYSTEM FOR USE IN DOWNHOLE APPLICATIONS

CROSS-REFERENCE TO RELATED APPLICATIONS

The present application is a national stage entry under 35 U.S.C. 371 of International Application No. PCT/US2022/011801, filed Jan. 10, 2022, which claims priority benefit of U.S. Provisional Application No. 63/144,321, filed Feb. 1, 2021, the entirety of which is incorporated by reference herein and should be considered part of this specification.

BACKGROUND

In a variety of well applications, casing is deployed downhole and cemented in place along the wellbore. Perforation operations may be performed to provide communication between the interior of the casing and the surrounding reservoir. Additionally, frac plugs may be sequentially deployed along the interior of the casing to facilitate fracturing of zones along the wellbore. During deployment of the casing, the casing may be subjected to a variety of forces which can cause ovality of the casing along sections of the wellbore. If a frac plug is set in one of these oval sections, it may not provide a full seal. For example, the ovality of the casing may cause the slips of the frac plug to contact the interior of the casing unevenly because slips in the larger diameter portion do not sufficiently reach the casing with enough bite to securely anchor the frac plug. As a result, some of the slips potentially do not provide sufficient support for the seal element in this area and this can lead to leaks or a blowout of the seal element.

SUMMARY

In general, a system and methodology provide a slip assembly, e.g. a frac plug assembly, having a plurality of slips. The plurality of slips may selectively be forced in a radially outward direction via, for example, a cone so as to set the slips against a surrounding casing or other tubing. The slip assembly further comprises a mechanism which allows different amounts of radial movement of individuals slips to ensure sufficient setting of the individual slips when the surrounding tubing is oval or otherwise out of round.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for constructing and utilizing a slip assembly having a plurality of slips. In a variety of applications, the slip assembly may be in the form of a frac plug assembly although the slip assembly may be used in many other types of assemblies and operations. As described in greater detail below, the plurality of slips may selectively be forced in a radially outward direction via, for example, a cone so as to set the slips against a surrounding casing or other tubing. The slip assembly further comprises a mechanism which allows different amounts of radial movement of individuals slips to ensure sufficient setting of the individual slips when the surrounding tubing is oval or otherwise out of round.

If a casing or other tubing is out of round, e.g. oval, at certain sections, the slip assembly can still be actuated in a manner which allows individual slips to set at different radial distances so that the slips achieve an even set and bite into the surrounding tubing. In deformed casing, for example, where the inner surface is not perfectly circular, some slips contact the interior surface of the casing before other slips. Effectively, the casing blocks further radially outward movement of the slips which make initial contact. However, the structure of the overall slip assembly described herein allows the other slips to continue moving radially outwards until these other slips also are forced into secure contact with the casing. Consequently, the full set of slips may be forced into full, gripping engagement with the surrounding casing/tubing even when the surrounding casing/tubing is out of round.

Figure 1:
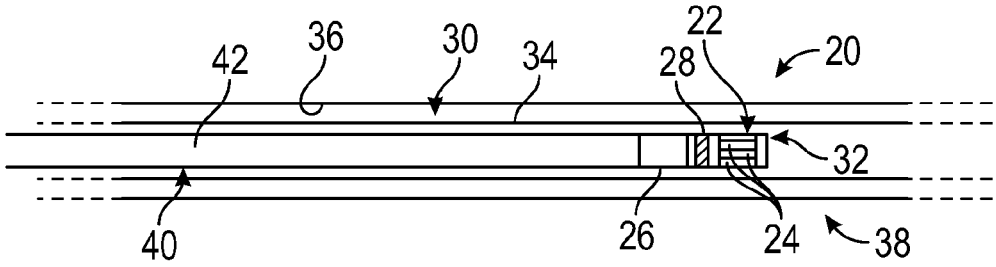
FIG. 1 is a schematic illustration of an example of a slip assembly, e.g. a frac plug assembly, deployed downhole through casing, according to an embodiment of the disclosure.

Referring generally to FIG. 1, an example of a well system 20 is illustrated as comprising a slip assembly 22. The slip assembly 22 is illustrated as having a plurality of slips 24 which may be actuated via a setting tool 26 between a radially inward position and a radially outward, set position. In some embodiments, the slip assembly 22 may be combined with a seal element 28, e.g. an elastomeric seal element, which may be radially expanded into sealing engagement with a surrounding tubing 30 as the slips 24 are set into engagement with an interior surface of the surrounding tubing 30.

According to an embodiment, the slip assembly 22 may be part of a frac plug assembly 32 and the tubing 30 may be in the form of casing 34 deployed in a borehole 36, e.g. a wellbore. The frac plug assembly 32 may be selectively set at a desired downhole position within casing 34 to facilitate a variety of fracturing operations performed on a surrounding formation 38. In this example, the frac plug assembly 32 is connected with setting tool 26 which, in turn, is deployed downhole via a suitable conveyance 40. In a variety of applications, the conveyance 40 may be in the form of coiled tubing 42 although other conveyances, e.g. wireline, may be used in some applications. The structure of slip assembly 22 enables secure setting of the frac plug assembly 32 (or other type of tool utilizing slip assembly 22) in tubing 30 even when the tubing 30 is oval or otherwise out of round.

Figure 2:
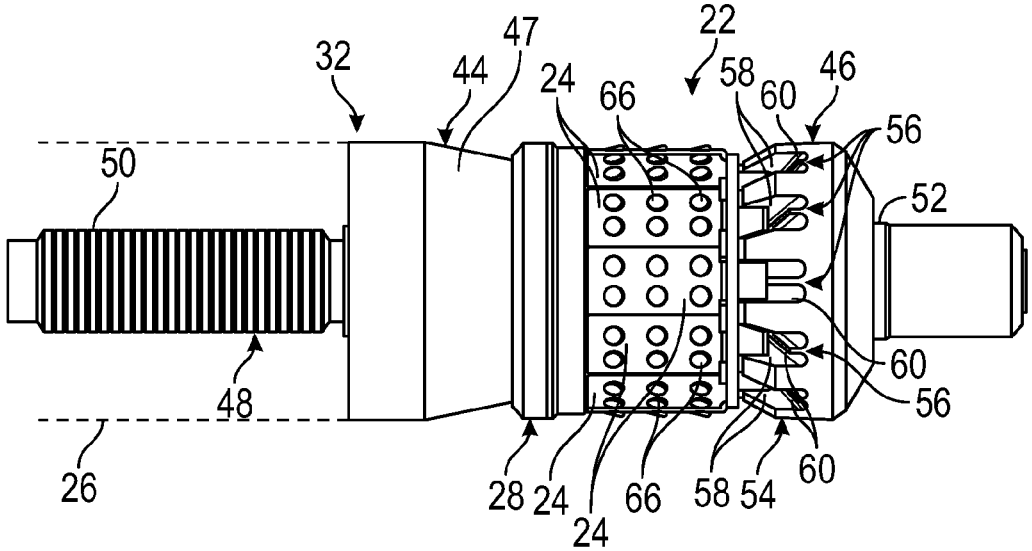
FIG. 2 is a side view of an example of a frac plug assembly utilizing a slip assembly, according to an embodiment of the disclosure.

Referring generally to FIG. 2, an example of the slip assembly 22/frac plug assembly 32 is illustrated. In this embodiment, the frac plug assembly 32 comprises a plurality of slips 24 positioned linearly between a cone 44 and a setting ring 46. The cone 44 has a sloped surface 47 which extends into an interior of the plurality of slips 24 and is designed to force the slips 24 in a radially outward direction as the slips 24 are squeezed linearly between the cone 44 and the setting ring 46. In other words, as the distance between cone 44 and the setting ring 46 is reduced, the slope 47 of cone 44 forces the slips 24 in the radially outward direction and ultimately into engagement with an interior of the surrounding tubing 30.

Additionally, the frac plug assembly 32 may comprise seal element 28 which also may be forced radially outward into engagement with the interior surface of the surrounding tubing 30. As illustrated, the seal element 28 may be positioned between the plurality of slips 24 and cone 44 such that the slope 47 of cone 44 also forces the seal element 28 to expand in a radially outward direction as the cone 44 and setting ring 46 undergo relative movement toward each other. However, other embodiments may utilize seal elements 28 located at other locations, e.g. locations external to cone 44, and may be actuated into sealing engagement with the surrounding interior surface of tubing 30 via other mechanisms.

In the example illustrated, the seal element 28, cone 44, and setting ring 46 are initially mounted about a support mandrel 48 via respective openings or passages sized to receive the support mandrel 48 therethrough. By way of example, the support mandrel 48 may comprise a mandrel extension 50 configured for engagement with setting tool 26. The mandrel 48 also may comprise an abutment 52 or other suitable mechanism to act against the setting ring 46 as the setting tool 26 forces cone 44 toward setting ring 46. As the distance between cone 44 and the setting ring 46 is reduced, the slope 47 of cone 44 forces both slips 24 and seal element 28 in a radially outward direction toward engagement with the surrounding tubing 30, e.g. casing 34.

If the surrounding tubing 30 has a certain degree of ovality or is otherwise out of round at the location slips 24 are set, some of the individual slips 24 will be moved into secure engagement with tubing 30 before others sufficiently engage tubing 30. However, the slip assembly 22/frac plug assembly 32 comprises a mechanism 54 which accommodates different amounts of radially outward movement of individual slips 24. The mechanism 54 allows slips 24 which have been sufficiently set against the surrounding tubing 30 prior to other slips 24 to remain in their radial position while the distance between cone 44 and setting ring 46 is further reduced. As this distance is further reduced, the other individual slips 24 are continually forced in a radially outward direction until the entire set of slips 24 is securely engaged with the surrounding tubing 30. The mechanism 54 effectively allows individual slips 24 which are restrained against further movement in a radially outward direction to continue to move linearly with respect to the setting ring 46 and/or cone 44. In the example illustrated, the mechanism 54 allows the radially restrained slips 24 to move farther into the setting ring 46 in a linear direction. It should be noted that in some embodiments, the support mandrel 48 may be released or otherwise removed once the full set of slips 24 has been fully engaged with the surrounding tubing 30.

The mechanism 54 may comprise a variety of features which allow individual slips 24 to shift in an axial/linear direction when placed under sufficient force. By way of example, the mechanism 54 may comprise a variety of springs or deformable members able to apply sufficient force to set the individual slips 24 into the interior surface of surrounding tubing 30. However, mechanism 54 also accommodates linear movement of those slips 24 into, for example, the setting ring 46 when further radially outward movement is constrained by engagement with surrounding tubing 30.

Figure 3:
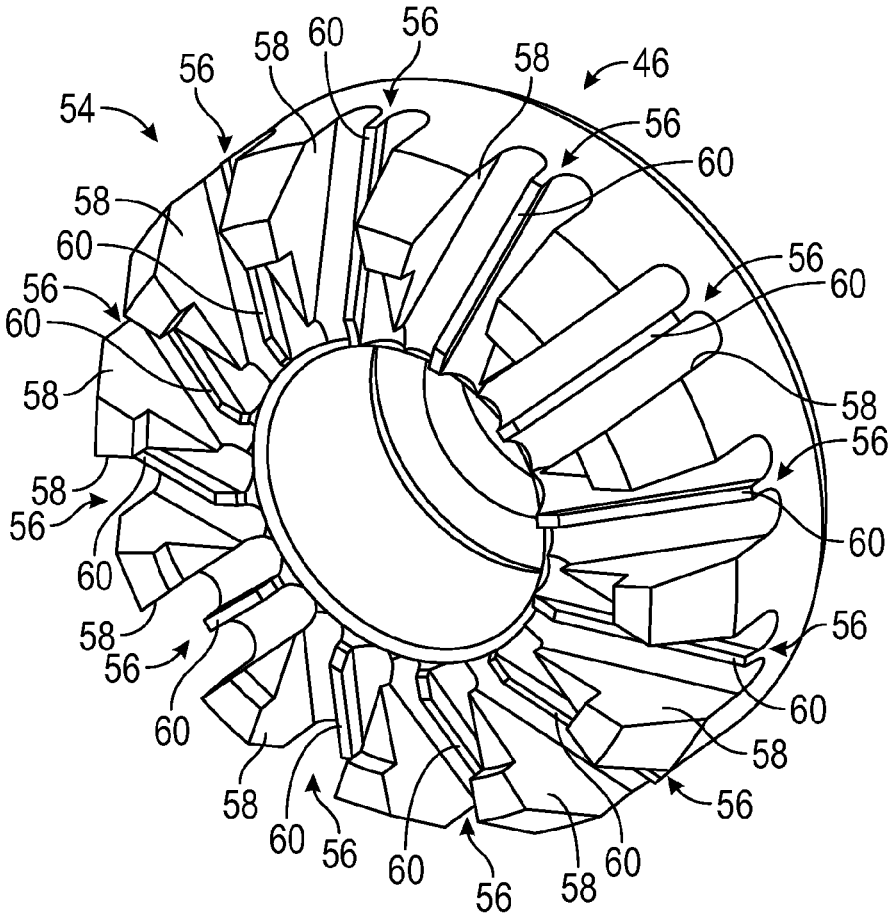
FIG. 3 is an illustration of an example of a setting ring of the frac plug assembly illustrated in FIG. 2, according to an embodiment of the disclosure.

As further illustrated in FIG. 3, an example of mechanism 54 comprises a plurality of crumple zones 56 which interact with corresponding slips 24. In this embodiment, each of the crumple zones 56 includes a sufficient gap or space 58 to linearly receive the corresponding slip 24. Within each space 58 is a deformable element 60 which may be in the form of a deformable ridge or other deformable element.

Each deformable element 60 is constructed with a material, e.g. a suitable metal material or composite material, and of a suitable size to drive the corresponding slip 24 against cone 44 with sufficient force to move the corresponding slip 24 radially outward and into set engagement with the interior surface of the surrounding tubing 30. Once the corresponding slip 24 is set and restrained against further radially outward movement, continued reduction of the distance between cone 44 and setting ring 46 causes the deformable element 60 to crumple such that the corresponding slip 24 is able to move linearly farther into the space 58. As the corresponding slip 24 moves farther into space 58, other slips 24 of the overall set of slips 24 are continually forced in a radially outward direction until they too are firmly set against the interior surface of the surrounding tubing 30. In this manner, the individual slips 24 may be forced to move radially outward in differing amounts so as to ensure secure engagement of the entire set of slips 24 even when the surrounding tubing 30 is oval or otherwise out of round.

By securely setting the entire set of slips 24, the seal element 28 also is better supported and protected against leaks and seal blowouts. Additionally, the ability to move individual slips 24 farther into setting ring 46 after radial movement is blocked helps achieve a better seal. The continued movement of cone 44 toward setting ring 46 ensures adequate pressure is applied against seal element 28 throughout to secure the seal element 28 in a sealing engagement with the interior surface of tubing 30.

The deformable elements 60 may be constructed from a variety of deformable materials, including metal materials, e.g. steel materials, composite materials, and other suitable materials. By way of example, the deformable elements 60 may be constructed from plastically deformable materials, such as metal materials, which plastically deform under sufficient force. The plastically deformable elements 60 are configured with sufficient strength to set the corresponding slips 24 while then plastically deforming under increased force acting between the corresponding slips 24 and setting ring 46.

Figure 4:
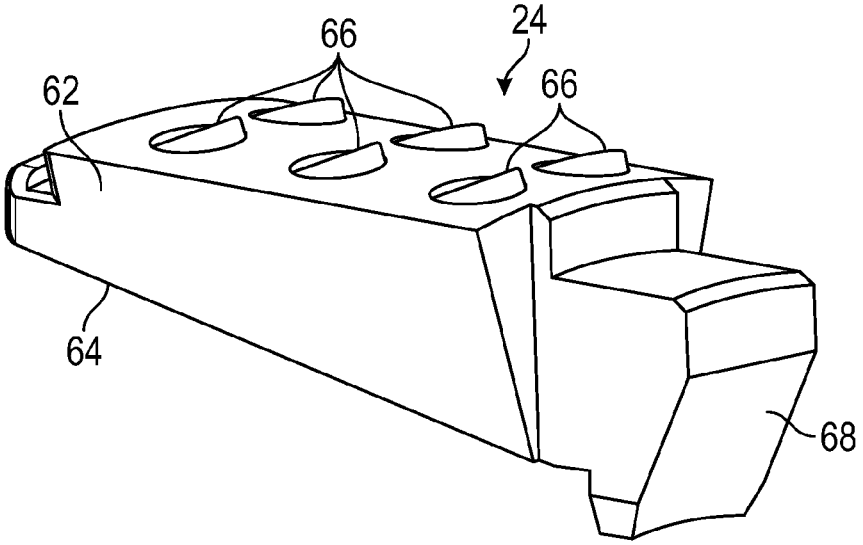
FIG. 4 is an illustration of an example of a slip which may be used in the frac plug assembly illustrated in FIG. 2, according to an embodiment of the disclosure.

Referring generally to FIG. 4, an example of one of the slips 24 is illustrated. In this embodiment, the slip 24 comprises a slip body 62 having a sliding surface 64 oriented for sliding engagement with the sloped surface 47 of cone 44. Generally opposite the sliding surface 64, a plurality of gripping members 66, e.g. teeth, buttons, or other suitable gripping members, is arranged to engage and grip the interior surface of surrounding tubing 30 once the slip 24 is shifted radially outward and into engagement with tubing 30. Additionally, the slip 24 may comprise an abutment end 68 constructed and oriented to engage the mechanism 54 of setting ring 46. For example, the abutment end 68 may be oriented and constructed to abut or otherwise engage the corresponding deformable element 60.

Figure 5:
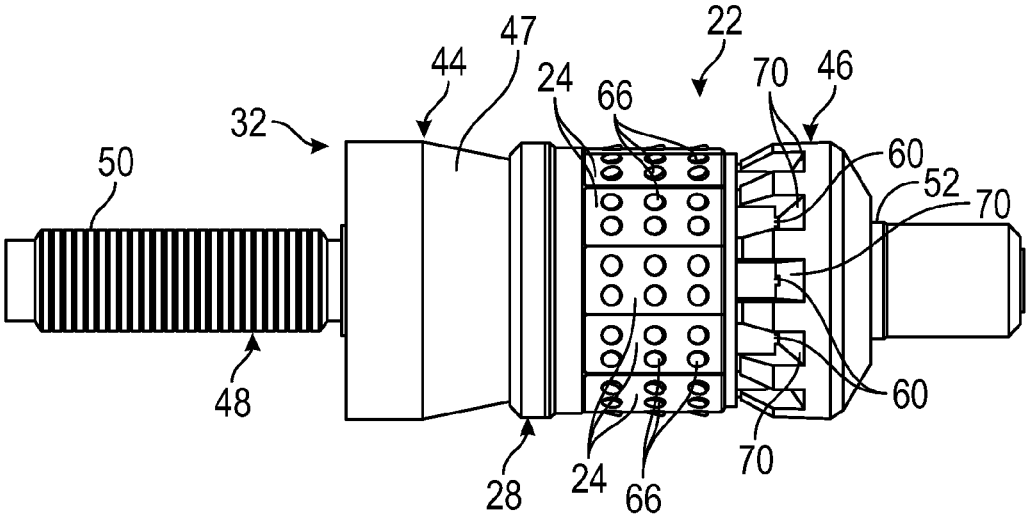
FIG. 5 is an illustration of another example of a frac plug assembly, according to an embodiment of the disclosure.
Figure 6:
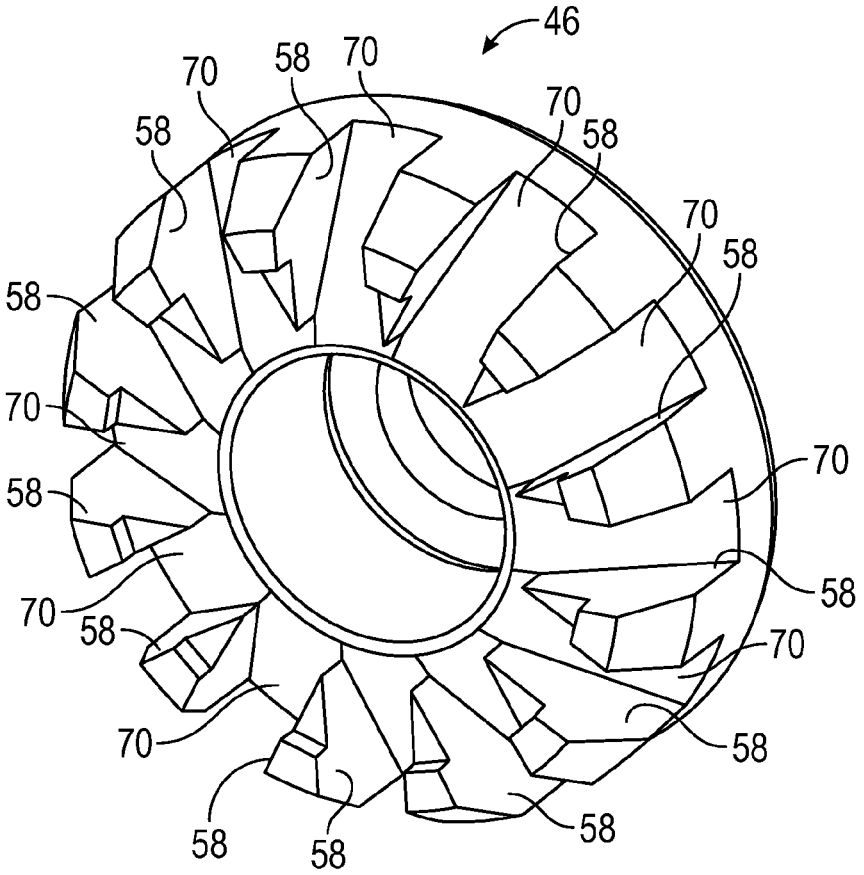
FIG. 6 is an illustration of an example of a setting ring of the frac plug assembly illustrated in FIG. 5, according to an embodiment of the disclosure.

Referring generally to FIG. 5, another embodiment of frac plug assembly 32 is illustrated. In this embodiment, many of the components and features are the same or similar to those of the embodiment illustrated in FIGS. 2-4 and common reference numerals have been used to label those components and features. In this example, the setting ring 46 comprises spaces 58 defined in part by abutment surfaces 70 rather than deformable elements 60, as illustrated in FIG. 6.

Figure 7:
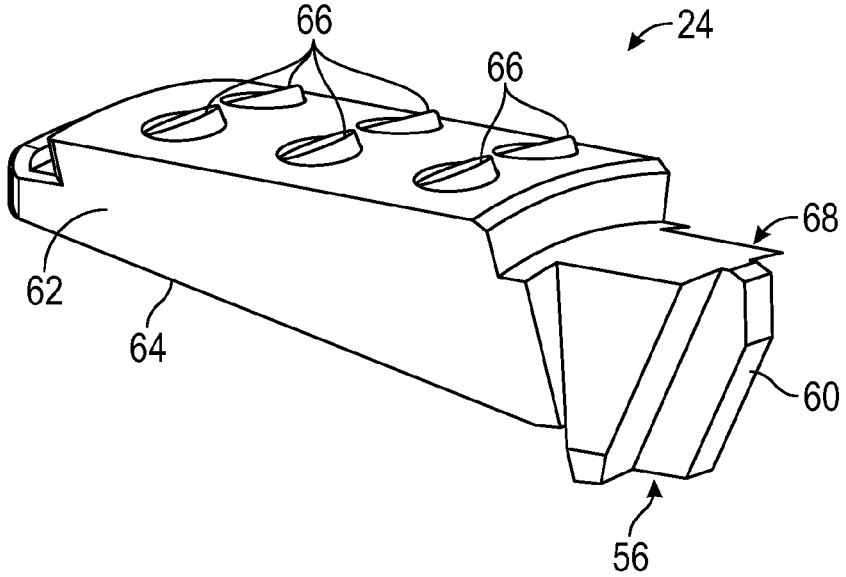
FIG. 7 is an illustration of an example of a slip which may be used in the frac plug assembly illustrated in FIG. 5, according to an embodiment of the disclosure.

With additional reference to FIG. 7, the mechanism 54 in this embodiment is established by locating the deformable elements 60 on the abutment ends 68 of the slips 24. As illustrated, each deformable element 60 is oriented to engage the corresponding abutment surface 70 of setting ring 46 in a manner which allows the radially outward expansion of the slip 24 until the slip 24 is fully engaged with the surrounding tubing 30. At this stage, continued reduction of the distance between the cone 44 and the setting ring 46 causes an increase in force acting on the deformable element 60 until the element 60 plastically deforms (or otherwise deforms) to accommodate further linear movement of the slip 24 into the setting ring 46. As described above, this allows the other slips 24 to be forced farther in the radially outward direction until the entire set of slips 24 is securely engaged with the surrounding tubing 30.

It should be noted that mechanism 54 may comprise a variety of plastically deformable or otherwise deformable elements 60 located on either or both of the setting ring 46 and the slips 24. In some embodiments, the deformable elements 60 may be in the form of springs or resilient materials constructed so as to provide sufficient resistance to deformation, thus enabling the desired movement of slips 24 along the slope 47 of cone 44. The mechanism 54 also may comprise various other types of features configured to accommodate the linear movement into the setting ring 46 once further radially outward movement has been blocked. The features of mechanism 54 also may be located between the slips 24 and the cone 44. In applications other than frac plug applications, the slip assembly 22 may be utilized in a variety of other types of tools in which the slips 24 act against suitable types of abutment rings or other features. With these other types of applications, the mechanism 54 may be appropriately located between the slips 24 and the corresponding abutment rings or other features.

Depending on the parameters of a given downhole operation, the slip assembly 22 may be used with casing 34 or with other types of tubing 30. As described herein, the slip assembly 22 may be utilized in frac plug assembly 32; however the slip assembly 22 may be employed in other types of well operations, tubing strings, and with other types of equipment. Additionally, the frac plug assembly 32 may include components and features of various sizes, configurations, and materials. For example, the slips 24, seal element 28, cone 44, and setting ring 46 may be constructed in various sizes and configurations. The number of slips 24 may vary according to the size of the tool and the environment in which it is used. In a variety of applications, the number of slips may be in the range from 8 to 16 slips. Additionally, the seal element 28 may be located between the cone 44 and the setting ring 46 or it may be located externally and squeezed or otherwise expanded into sealing engagement with the surrounding interior surface of tubing 30.

Similarly, a variety of setting tools 26 may be used to interact with the corresponding components, e.g. support mandrel 48 and cone 44, and to appropriately set the frac plug assembly 32 at a desired location within casing 34. Many types of setting tools 26 are commercially available and suitable for fracturing operations and other downhole operations. Various types of fracture members or other release mechanisms may be used to release the support mandrel 48 from the frac plug assembly 32 once the frac plug assembly 32 is set. Additionally, the frac plug assembly 32 may incorporate various ball seats or other features to enable subsequent closure of the interior of the casing 34 following release of the support mandrel 48. The slip assembly 22, whether used in frac plug assembly 32 or other downhole tools, may be employed in many types of operations to ensure an improved setting of the overall number of slips 24 against a surrounding, out of round tubing 30.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a frac plug assembly having:

a support mandrel;

a seal element mounted about the support mandrel;

a cone mounted about the support mandrel;

a setting ring mounted about the support mandrel, the setting ring comprising:

a plurality of crumple zones, wherein each crumple zone includes a recess and a deformable element, wherein the deformable element protrudes from a base surface of the recess; and a plurality of slips mounted about the support mandrel and disposed between the cone and the setting ring, wherein each slip comprises an abutment surface and each abutment surface is disposed in a corresponding crumple zone, wherein each slip is forced in a radially outward direction as a distance between the cone and the setting ring is reduced, wherein each abutment surface engages a corresponding deformable element to accommodate differences in radially outward movement of each slip, and wherein the deformable elements are configured to deform as the distance between the cone and the setting ring is reduced.

2. The system of claim 1, wherein the distance between the cone and the setting ring is selectively reduced via a setting tool.

3. The system of claim 1, wherein each deformable element allows a reduction in the distance between the cone and the setting ring without radial movement of the corresponding slip by plastically deforming upon engagement with the abutment surface of the corresponding slip.

4. The system of claim 1, wherein each deformable element in each crumple zone comprises a deformable metal element.

5. The system of claim 1, wherein the plurality of slips comprises 8 to 16 slips.

6. The system of claim 1, further comprising a setting tool coupled to the frac plug assembly and coupled to coiled tubing to enable deployment of the frac plug assembly to a desired downhole location and to enable setting of the frac plug assembly by reducing the distance between the cone and the setting ring.

7. A system comprising:

a slip assembly having:

a support mandrel;

a cone mounted about the support mandrel;

a setting ring mounted about the support mandrel, the setting ring comprising a plurality of recesses, wherein each recess includes a base surface; and a plurality of slips mounted about the support mandrel and disposed between the cone and the setting ring, wherein each slip comprises a deformable element protruding from a surface of each slip and each deformable element is disposed in a corresponding recess, wherein each slip is forced in a radially outward direction as a distance between the cone and the setting ring is reduced, wherein each deformable element engages with a corresponding base surface to accommodate differences in radially outward movement of each slip and wherein the deformable elements are configured to deform as the distance between the cone and the setting ring is reduced.

8. The system of claim 7, wherein the slip assembly further comprising a setting tool positioned to reduce the distance between the cone and the setting ring.

9. The system of claim 7, wherein the deformable elements are plastically deformable.

10. The system of claim 7, wherein each deformable element is a deformable metal element.

11. The system of claim 7, wherein the slip assembly further comprises a seal element disposed between the cone and the setting ring.

12. A method for setting a frac plug assembly in a casing, comprising:

reducing a distance between a cone and a setting ring disposed about a support mandrel of a frac plug assembly, wherein reducing the distance between the cone and the setting ring forces a first slip and a second slip radially outward from the support mandrel to engage the first slip with the casing; and further reducing the distance between the cone and the setting ring, wherein further reducing the distance forces the second slip radially outward from the support mandrel and deforms a deformable element protruding from a base surface of a recess of the setting ring engaged with an abutment surface of the first slip.

13. The method of claim 12, wherein a seal is disposed between the cone and the setting ring.

14. The method of claim 12, further comprising engaging the second slip with the casing.

* * * * *